US011642268B2

(12) United States Patent
Thorpe

(10) Patent No.: US 11,642,268 B2
(45) Date of Patent: May 9, 2023

(54) LIFTING SYSTEM

(71) Applicant: Autochair Limited, Alfreton (GB)

(72) Inventor: Andrew Richard Thorpe, Sheffield (GB)

(73) Assignee: Autochair Limited, Alfreton (GB)

( * ) Notice: Subject to any disclaimer, the term of this patent is extended or adjusted under 35 U.S.C. 154(b) by 84 days.

(21) Appl. No.: 17/154,113

(22) Filed: Jan. 21, 2021

(65) Prior Publication Data

US 2021/0220199 A1 Jul. 22, 2021

(51) Int. Cl.
*A61G 7/10* (2006.01)

(52) U.S. Cl.
CPC ..... *A61G 7/1073* (2013.01); *A61G 7/1015* (2013.01)

(58) Field of Classification Search
CPC ..... A61G 3/062; A61G 3/063; A61G 5/10; A61G 7/1015; A61G 7/1059; A61G 7/1073; A61G 7/1078; B66C 1/66
See application file for complete search history.

(56) References Cited

U.S. PATENT DOCUMENTS

| | | | | |
|---|---|---|---|---|
| 717,663 | A | 1/1903 | Fabian et al. | |
| 1,113,781 | A | 10/1914 | Griffin | |
| 2,975,434 | A | 3/1961 | Butler et al. | |
| 7,802,328 | B2 * | 9/2010 | Lingegard | A61G 7/1078 5/89.1 |
| 11,007,103 | B2 * | 5/2021 | Custeau-Boisclair | A61G 7/1078 |
| 2006/0216126 | A1 * | 9/2006 | Mechling | A61G 5/10 410/7 |
| 2009/0307840 | A1 | 12/2009 | Lingegard | |
| 2012/0294699 | A1 | 11/2012 | Sandoz | |
| 2014/0144861 | A1 | 5/2014 | Davis | |
| 2017/0137265 | A1 | 5/2017 | Menville | |
| 2018/0021195 | A1 | 1/2018 | Custeau-Boisclair et al. | |
| 2018/0029846 | A1 | 2/2018 | Verbrugge et al. | |
| 2018/0344553 | A1 | 12/2018 | Lyckestig et al. | |
| 2019/0290520 | A1 * | 9/2019 | Smith | A61G 3/063 |
| 2019/0308854 | A1 | 10/2019 | Magill et al. | |

FOREIGN PATENT DOCUMENTS

| | | | | |
|---|---|---|---|---|
| EP | 0700859 | A1 | 3/1996 | |
| EP | 1647249 | A1 * | 4/2006 | A61G 7/1051 |
| EP | 1647249 | B1 | 8/2007 | |
| EP | 1928390 | B1 | 12/2014 | |
| EP | 3788903 | A1 * | 3/2021 | A44B 11/2584 |
| FR | 2699129 | A1 | 6/1994 | |

(Continued)

*Primary Examiner* — David R Hare
*Assistant Examiner* — Alexis Felix Lopez
(74) *Attorney, Agent, or Firm* — Young Basile Hanlon & MacFarlane, P.C.

(57) ABSTRACT

A lifting system for a mobility device has a bracket fixed to the mobility device. A hoist connector is configured to removably connect to the bracket to provide lifting of the mobility device in use. One of the bracket and the hoist connector has a pin and the other of the bracket and the hoist connector comprises a clip, the pin having a head formation and a neck formation. The clip has an aperture configured to pass over the head formation in use and into engagement with the neck formation such that the clip is loosely held on the pin, and where the clip has a close fit with the head formation to prevent unintentional disengagement from the pin in use.

16 Claims, 7 Drawing Sheets

(56) References Cited

FOREIGN PATENT DOCUMENTS

| | | | | | |
|---|---|---|---|---|---|
| GB | 2542556 | A | | 3/2017 | |
| GB | 2553135 | A | * | 2/2018 | ..... A61G 3/0209 |
| SU | 472887 | A1 | | 6/1975 | |
| WO | 2007035098 | A2 | | 3/2007 | |
| WO | 2018/037247 | A1 | | 3/2018 | |
| WO | 2018091918 | A1 | | 5/2018 | |

* cited by examiner

LIFTING SYSTEM

CROSS-REFERENCE TO RELATED APPLICATION(S)

This application claims priority to United Kingdom Application Patent Serial No. GB 2000907.2 filed Jan. 22, 2020, the entire disclosure of which is hereby incorporated by reference.

TECHNICAL FIELD

The present invention relates to a lifting system for a vehicle, particularly for a lifting system for a mobility device.

BACKGROUND

A prior art lifting system is disclosed in WO2018/037247. The lifting system comprises a bracket 1 for a lifting a mobility scooter or the like. The scooter may be lifted into a user's vehicle. The bracket 1 is removably connected to the scooter via a post 38 fixed to the scooter. The bracket 1 comprises a pair of lateral spreader bars 3 at the sides thereof. The spreader bars 3 comprise a fastener 37 extending therethrough configured to connect to a hoist mechanism to allow lifting of the mobility scooter. As shown in FIG. 1 of the prior art document, the hoist mechanism comprises a clip 3' configured to engage and retain the fastener. The clip 3' comprises a spring clip to retain the fastener in place.

The inventor has found numerous drawbacks with the prior art system. In order to adequately secure the fastener in place, the spring clip must have sufficient biasing force. This biasing force must be overcome when disconnecting the fastener, which may be difficult for those with reduce mobility, strength and/or dexterity (i.e. the most likely users of a mobility scooter).

Other prior art systems use a carabiner or the like connected to loop on the bracket, however, similarly, these may be difficult to release. The scooter is configured to be placed into the boot of a car, and so space is at a premium. The carabiner clip or loop project outwardly and so may engage the side walls of the car.

Additionally, carabiners and other clips may rattle when the user is driving the vehicle with the scooter stowed therein, which may cause irritation or may cause the carabiner/clip to become disconnected.

It is an aim of the present invention to overcome or ameliorate one or more of the above problems.

SUMMARY

According to an aspect of the present invention, there is provided a lifting system for a mobility device comprising a bracket fixed to the mobility device, a hoist connector configured to removably connect to the bracket to provide lifting of the mobility device in use; where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation.

A shape of an outer surface of the head formation may be configured to conform to the shape of an inner surface of the clip opening.

The neck formation may comprise a spacer arranged to abut the bracket to hold the head formation at a predetermined spacing from the bracket in use.

The neck formation may comprise a shaft portion configured to extend through the bracket.

The neck formation may comprise the shaft portion and the spacer, the width or profile of the spacer being different from the width and/or profile of the shaft portion.

A biasing member may be interposed between the head formation and bracket, the biasing member arranged to contact the clip when in engagement with the pin.

The biasing member may surround the neck formation of the pin.

The biasing member may comprise one or more side wall configured to engage the head formation and/or the bracket.

The biasing member may have two spaced side walls and the clip is held between the side walls of the biasing member when in engagement with the pin.

The biasing member may be configured to resiliently retain the clip on the pin.

The biasing member may be formed of a resilient material.

The biasing member may comprise a magnet provided on one or both of the pin and the clip configured to retain the clip on the pin.

The other of the pin and clip may comprise a magnetic material.

The pin may comprise a magnet, the magnet comprising a substantially annular shape.

The magnet or magnetic material may be provided on a side of the head portion proximal the bracket.

The system may comprise a biasing member arranged to bias the clip away from a condition in which the aperture is aligned with the head formation when in engagement with the pin.

The head formation may comprise a locating feature configured to engage a corresponding locating feature on the clip to ensure correct orientation of the clip relative to the head formation when the clip is passed thereover the pin.

The locating feature may comprise a protrusion on one of the aperture and the head formation configured to engage a recess on the other of the aperture and the head formation.

The head formation and/or aperture may be substantially circular.

The clip and/or pin may comprise an angled/chamfered surface configured to guide the clip and pin into alignment when passing thereover.

The angled surface may comprise a tapered surface on a side of the head formation distal the bracket in use.

The angled/chamfered surface may be provided on one side of the head formation or clip only and/or an opposing side of the head formation or clip may comprise a flat face.

The bracket may comprise an elongate aperture therein and the pin may be connected to the bracket through the aperture at a desired location along the length of the aperture.

A portion of the pin may comprise at least one flat surface configured to engage the elongate aperture to prevent rotation of the pin therein.

The bracket may be connected to the mobility device via an upstanding post of the mobility device, the bracket being rigidly mounted with the post.

A plurality of said brackets may be provided and the post is provided with a cross bar arranged to space the brackets on either side of the post.

The lifting system may comprise a hoist arranged to raise and lower the hoist connector in use.

According to a second aspect of the invention, there is provided: a lifting system for a mobility device comprising: a bracket fixed to the mobility device, a hoist connector configured to removably connect to the bracket to provide lifting of the mobility device in use; where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation such that the clip is held on the pin, and where a biasing member is arranged to bias the clip away from a condition in which the aperture is aligned with the head formation when in engagement with the pin.

According to third aspect of the invention, there is provided: a lifting system for a mobility device comprising: a bracket fixed to the mobility device, a hoist connector configured to removably connect to the bracket to provide lifting of the mobility device in use; where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation such that the clip is loosely held on the pin, and where the clip and/or pin comprises an angled/chamfered surface configured to guide the clip and pin into alignment when passing thereover.

According to a further aspect of the invention, there is provided a lifting system for a mobility device comprising: a bracket fixed to the mobility device, a hoist connector configured to removably connect to the bracket to provide lifting of the mobility device; where one of the bracket and the hoist mechanism comprises a pin and the other of the bracket and the hoist mechanism comprises a clip configured to pass over the pin and into engagement therewith such that the clip is held on the pin; and where one or both of the pin and the clip comprises a biasing member configured to retain or constrain the clip whilst on the pin.

The biasing member may comprise a resilient material and/or a magnet.

BRIEF DESCRIPTION OF THE DRAWINGS

Practicable embodiments of the invention are described in further detail below with reference to the accompanying drawings, of which.

DETAILED DESCRIPTION

Figure 1:
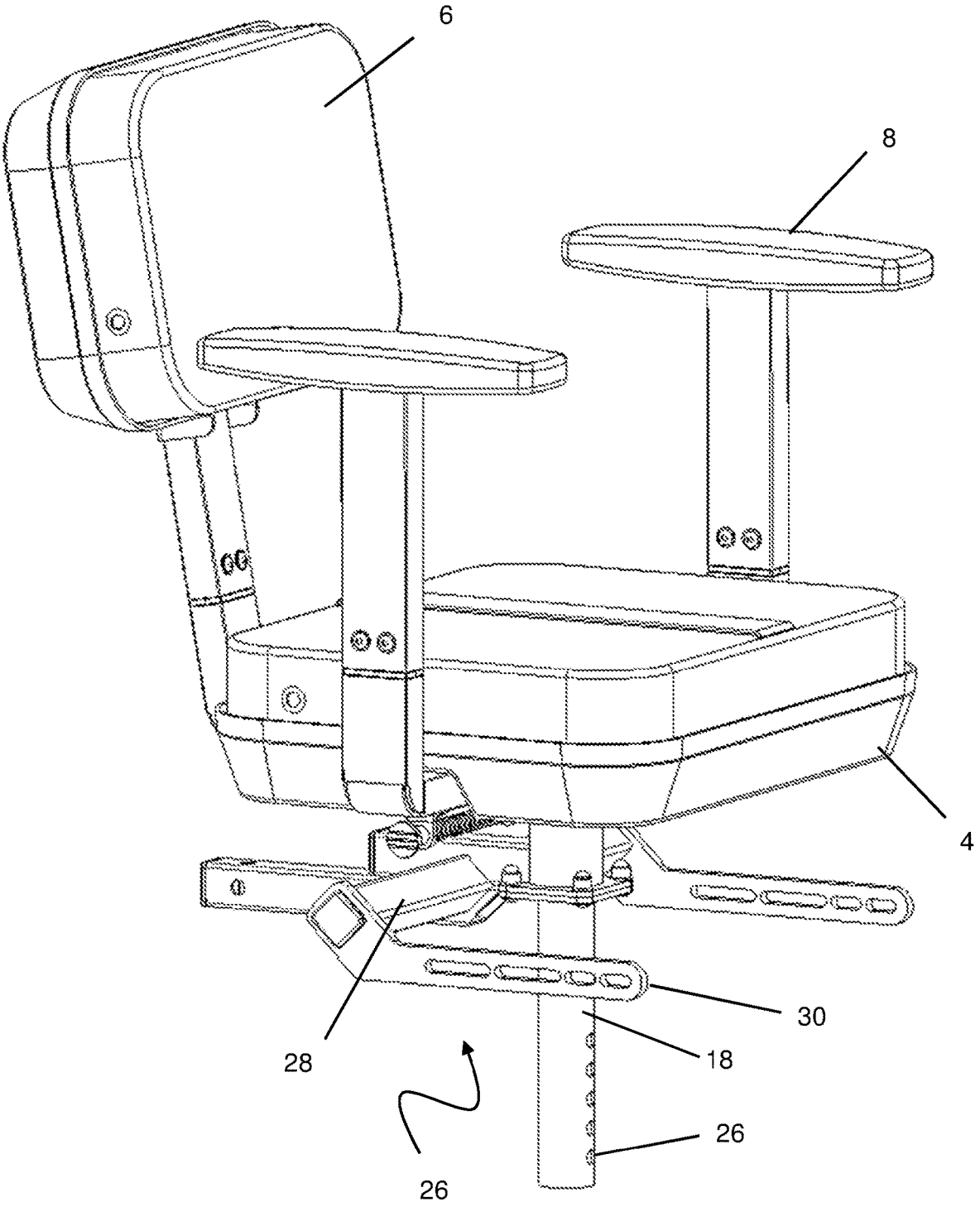
FIG. 1 shows a 3-dismensional view of a seat assembly.
Figure 2:
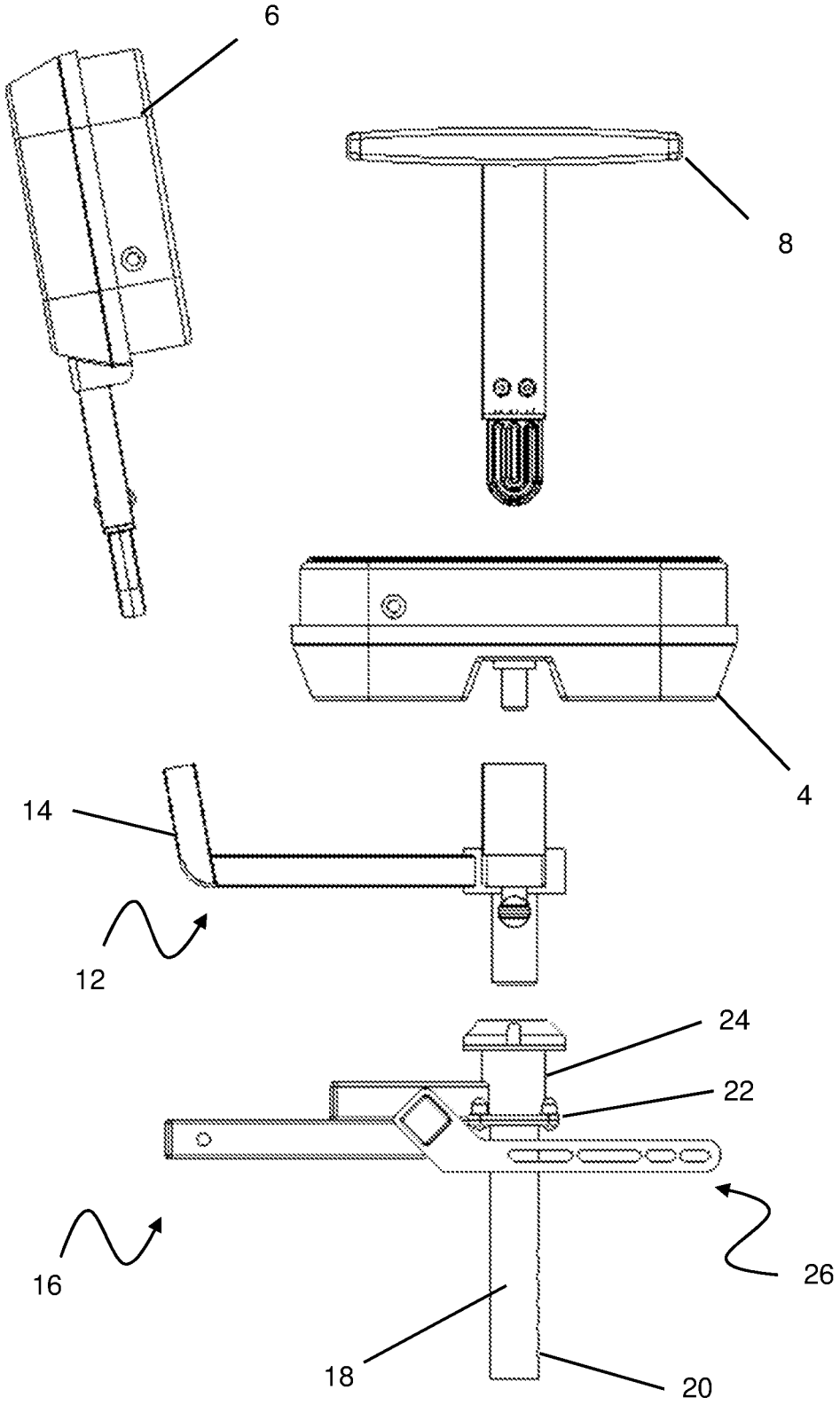
FIG. 2 shows an exploded side view of the seat assembly.
Figure 3:
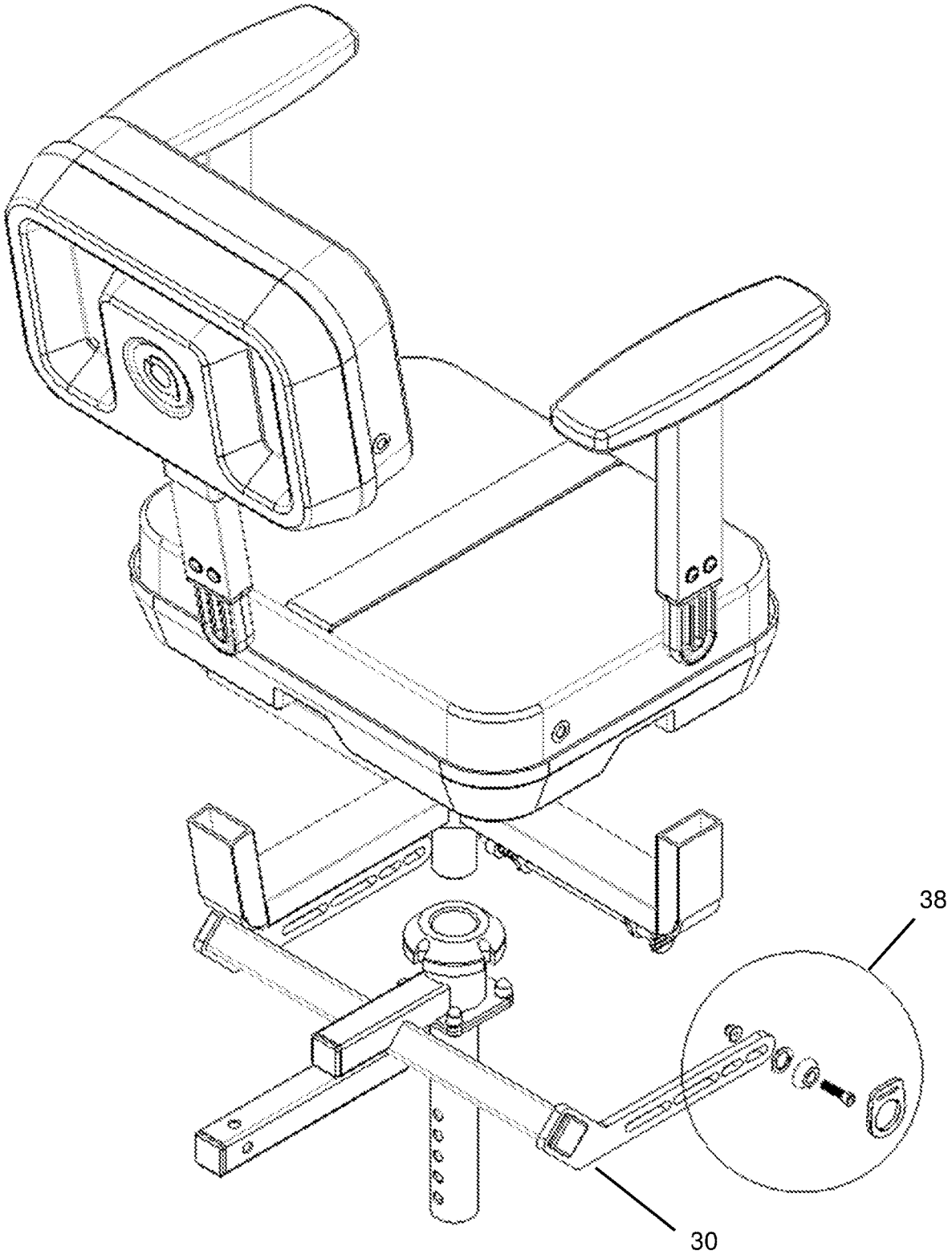
FIG. 3 shows an exploded three-dimensional view of the seat assembly with the lifting system.

FIGS. 1 and 2 show a seating assembly 2. The seating assembly 2 is configured to support a user of a vehicle in use (i.e. provide a seat). The seating assembly 2 is intended for use with a vehicle adapted for people with mobility issues, such as a mobility scooter, power chair, or other electrically powered mobility device to be lifted using a hoist. The vehicle can thus be lifted into and out of, e.g. the boot/trunk of, an automobile or other passenger vehicle using the hoist.

The seating assembly 2 comprises a seat portion 4 configured to support the user's buttocks and legs in use. A back-rest 6 is provided at a rear side of the seat portion and is configured to supports the user's back in use, e.g. in a lumbar and/or thoracic region of the spine. Two arm-rests 8 are provided at the sides of the seat portion and are configured to supports the user's arms, e.g. forearms, in use. The seat portion 4 and/or back-rest 6 and/or arm-rests 8 may comprise cushioning material or the like configured to support and provide comfort for the user. Conventional foam or other padding may be used.

The assembly 2 comprises a mounting arrangement configured to connect the assembly 2 to the vehicle, e.g. a mobility scooter.

The mounting arrangement comprises a yoke 12 configured to support the seat portion 4, the back-rest 6 and the arm-rests 8 in use, whilst allowing simple disassembly thereof by an end user.

The back-rest 6 and arm-rests 8 are removably attached to the yoke 12 (i.e. via arms 14). The back-rest 6 and arm-rests 8 are therefore separable from the seat portion 4. The back-rest 6 and arm-rests 8 are configured to be received within the arms 14 (i.e. within a hollow section of the arms 14).

The yoke 12 is itself mounted to a support structure 10 on the vehicle. Although a specific seat assembly is described above, the precise seat makeup is not critical and other seats could be mounted to the The support structure 10 of the mounting arrangement comprises a base portion 16 configured to be connected to the vehicle in use. The base portion 16 is configured to be connected to the vehicle in a permanent or semi-permanent fashion (i.e. the connection is maintained in day-to-day use). The base portion 16 is typically a permanent installation of the vehicle.

The base portion 16 comprises a pillar/post 18 mounted so as to extend upwardly from the vehicle. The pillar 18 comprises a plurality/series of apertures 20 along a lower portion thereof to receive fasteners or the like.

An upper end of the pillar 18 comprises a mounting plate 22 for mounting of both an upper pillar portion 24 and a lifting support structure 26 configured to allow lifting of the vehicle, e.g. using a hoist mechanism. The lifting structure 26 is thus rigidly mounted to the pillar 18.

The upper pillar portion 24 may be affixed atop the pillar 18 using other conventional means and provides a formation arranged to receive the yoke 12 of the seat assembly. The upper pillar portion 24 may be hollow or recessed in this regard, i.e. arranged to receive a protrusion of the yoke 12, or vice versa.

The yoke 12 is removably coupled to the base portion 16 when mounted. The yoke 12, seat portion 4, back-rest 6 and arm-rests 8 are therefore separable from the pillar 18 of the vehicle.

The lifting structure 26 comprises a cross bar 28 and a bracket 30 depending from each end of the cross bar 28. The brackets 30 are provided at either side of the seat portion 4. The brackets thus provide spaced attachment points for attaching to a spreader bar on the hoist in use. The brackets 30 comprise a first portion 32 connected to the cross bar 28 and a second portion 34 extending therefrom. The second portion 34 is angled with respect to the first portion 32 and is elongate in form. The second portion 34 may extend in a substantially horizontal direction in use and provides the attachment point for the lifting system described below.

Figure 4:
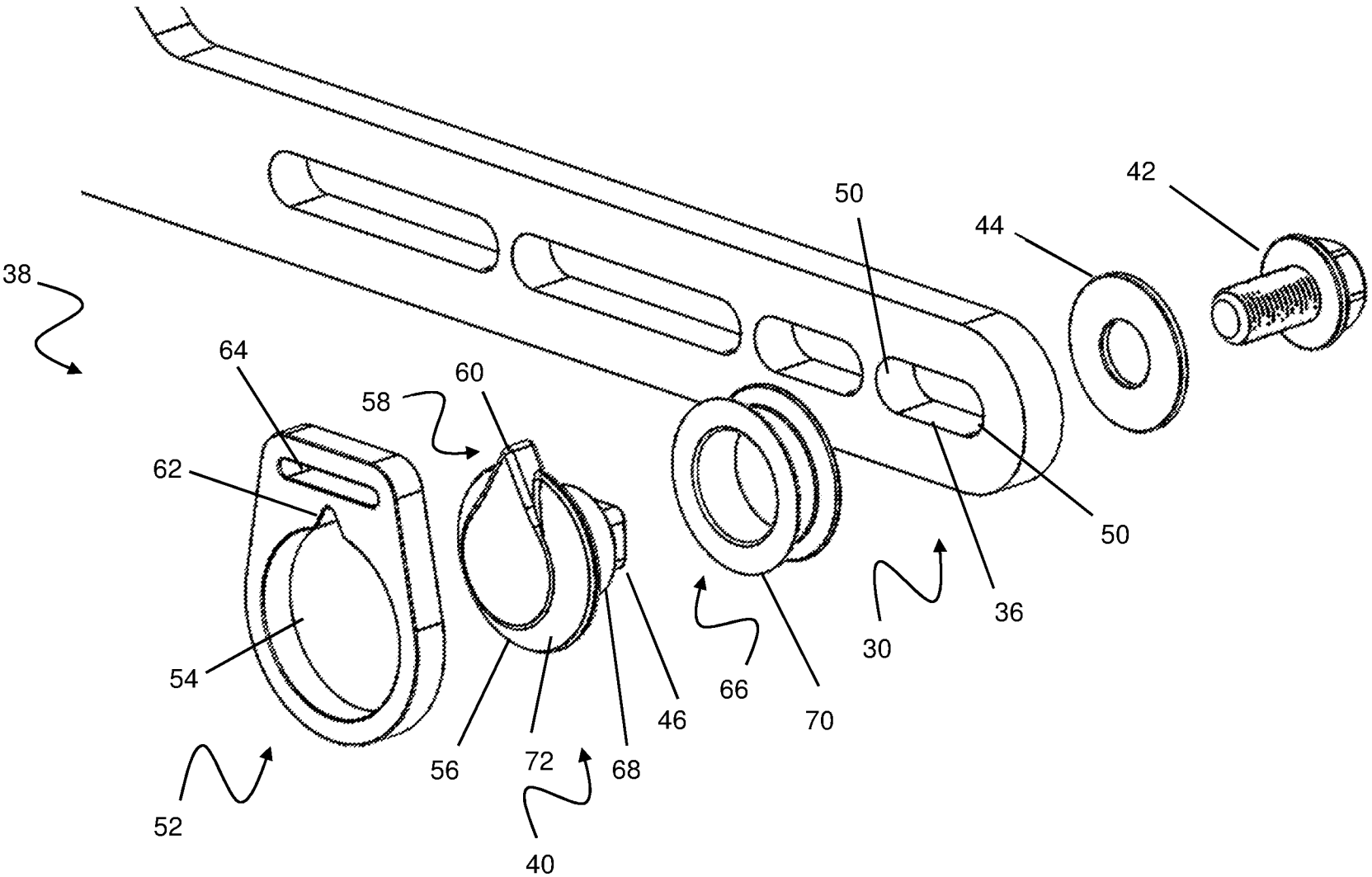
FIG. 4 shows an exploded three-dimensional view of a first example of a lifting system.

The bracket 30 comprises a plurality of apertures 36 extending therethrough configured to allow attachment of the hoist mechanism. The apertures are spaced along the second portion 34, and thus are spaced in a horizontal direction in use. Alternatively, as shown in FIG. 4, a single elongate aperture 36 may be provided.

The hoist mechanism is connected to the bracket 30 via a lifting system 38, which may be described as being a clip and pin type arrangement, by which a clip is removably engageable with a pin on the bracket to lift the vehicle. A first embodiment of the lifting system 38 is shown in closer detail in FIG. 5.

The lifting system 38 comprises a pin 40. The pin 40 is configured to extend through the aperture 36 (e.g. via a neck or shaft portion 68 thereof). The pin 40 is movably received within the aperture 36. The pin 40 is secured within the aperture using a fastener, for example, a threaded bolt 42. The pin 40 itself thus acts as a retainer (e.g. a nut). The pin 40 may therefore be removable from the bracket 30. A washer 44 may be interposed between the head of the bolt 42 and the bracket 30.

Whilst the portion of the lifting system that is mounted to the bracket is described herein as a 'pin' 40, it will be appreciated that it need not be of a conventional pin shape. The pin 40 in the examples described herein has a head formation 56 of greater width dimension relative to a neck portion, e.g. shaft portion 68, extending behind the head formation.

A portion 44 of the pin 40 extending through the aperture 36 may be shaped to prevent rotation of the pin 40 relative to the bracket 30. The portion 44 may comprises one or more flat edge 46 configured to engage an inner edge 48 of the aperture. For example, the portion 44 may be substantially square/rectangular or a rounded square/rectangle. The ends 50 of the aperture 36 may be shaped to conform with the shape of the portion 44.

The bracket 30 is located approximately above the centre of the gravity of the scooter. Therefore, the pin 40 can be moved along the aperture 36 and/or to an adjacent aperture to allow fine adjustment of the location of the pin 40 to a position directly above the centre of the gravity of the scooter. This prevents unwanted tipping or swinging of the scooter and allows the hoist mechanism to be attached to scooter at a single point on each side of the scooter.

The lifting 38 system comprises a clip 52 configured to engage the pin 40. The clip 52 provides a detachable connection between the hoist mechanism and the bracket 30 in use (i.e. a hoist connector). The clip 52 comprises an aperture 54 configured to pass over the pin 40. The clip 52 passes over a head portion 56 of the pin 40 that comprises an increased width. The head portion is spaced from the bracket 20, e.g. by the neck 68, such that the clip is retained between the head portion 56 and the bracket 20. Once the clip has passed over the head portion 56 it can contact the neck portion of reduced width, thereby causing a natural offset of the aperture 54 and head formation 56 that prevents unwanted removal of the clip 52. That is to say the clip 52 will abut the rear of the head formation unless the user purposely aligns the aperture 54 with the head formation 56 to remove the clip.

The head portion 56 is shaped to provide a close fit with the aperture 54 (i.e. the outer surface is of the head portion 56 is the same shape/size as the inner surface of the aperture 54). The aperture 54 therefore must be accurately aligned with the head portion 56 to allow removal of the clip 52 by passing the clip 52 back over the pin 40. The clip 52 is loosely held on the pin 40 (i.e. is not held by a latch, clip or the like). The close fit therefore ensures the clip 52 does not unintentionally disconnect from the pin 40, for example, by shaking of the clip 52.

The pin 40/aperture 54 may be substantially circular. The clip 52 therefore provides a ring-like or annular arrangement.

The pin 40 comprises a locating feature 58 to ensure correct alignment/orientation of the clip 52 relative to the pin 40 when passing thereover. The locating feature 58 comprises a protrusion 60 located on the head portion 56 configured to be received a correspondingly shaped recess 62 in the clip aperture 54. This ensures the clip 52 can only pass over the pin 40 in a single orientation. Any relative rotation between the clip 52 and pin 40, once connected, will prevent removal of the clip 52 from the pin 40 due to the offset of the protrusion 60 and recess 62.

The protrusion 60 extends beyond the edge of the head portion 56. The protrusion 60/recess 62 may be substantially triangular/wedge shaped.

The recess 62 is provided adjacent a portion of the clip 52 configured to receive a webbing/belt of the hoist mechanism (e.g. via aperture 64). The recess 62 is therefore provided at an uppermost side of the aperture 54 during lifting. When the mobility vehicle is stowed in the car, the webbing may become slack, thus the recess 62 will naturally rotate away from the protrusion 60. This prevents disconnection of the hoist mechanism from the mobility vehicle during transit, and so the user does not have to reconnect the system in the limited space provide in the transport vehicle (e.g. within the car boot).

In some embodiments, the protrusion 60/recess 62 may not be located at top dead centre of the aperture, e.g. potentially being located at the side or the lowermost portion of the pin 40/clip 52 (i.e. at opposing side of the clip 52 from the connection between the webbing and the clip). In some embodiments, a plurality of recesses 62 may be provided to allow disconnection at two or more select orientations.

Additionally or alternatively, the locating feature 58 can be provided by an irregular and/or asymmetrically shaped pin 40/aperture 54.

A resilient member 66 is provided between the pin 40 and the clip 52. The resilient member comprises a resiliently deformable material, for example, rubber or silicone. The resilient member therefore prevents rattling of the clip 52 against the pin 40 and/or the bracket 20. The resilient member 66 surrounds a shaft portion 68 of the pin 40 and sits thereon (e.g. in an annular fashion). The resilient member is therefore interposed between the head portion 56 and the bracket 20, i.e. behind the head portion.

The resilient member 66 comprises a plurality of upstanding side walls 70 configured to engage the bracket 20 and the pin head portion 56 respectively. The side wall have a width less than or equal to the width of the clip aperture 54 to allow the clip 52 to pass thereover. When connect to the bracket 20, the clip 52 is configured to surround the resilient member 66. For example, when lifting, the inner surface of the aperture 54 engages the lowermost side of the resilient member 66.

The resilient member may comprise a collar or cuff formation. The resilient member provide a biasing force, i.e. may be in compression, to press the clip 52 against the head portion 56 or bracket 20 when the clip is attached over the pin. Alternatively, the clip may be a loose fit over the resilient member and the resilient member may constrain the freedom of movement available to the clip when on the pin in use.

The head portion 56 may have tapered/bevelled edges 72 configured to guide the clip 52 into alignment with the pin 40. The tapered edges 72 are provided on a side of the head portion 56 distal the bracket 30, i.e. a front/outer face of the head portion.

Although only a single pin 40/clip 52 arrangement is shown, it can be appreciated that each bracket 30 comprises a pin 40/clip 52 arrangement. In some embodiments, a plurality of pin 40/clip 52 arrangements may be provided on each bracket 30.

Figure 5:
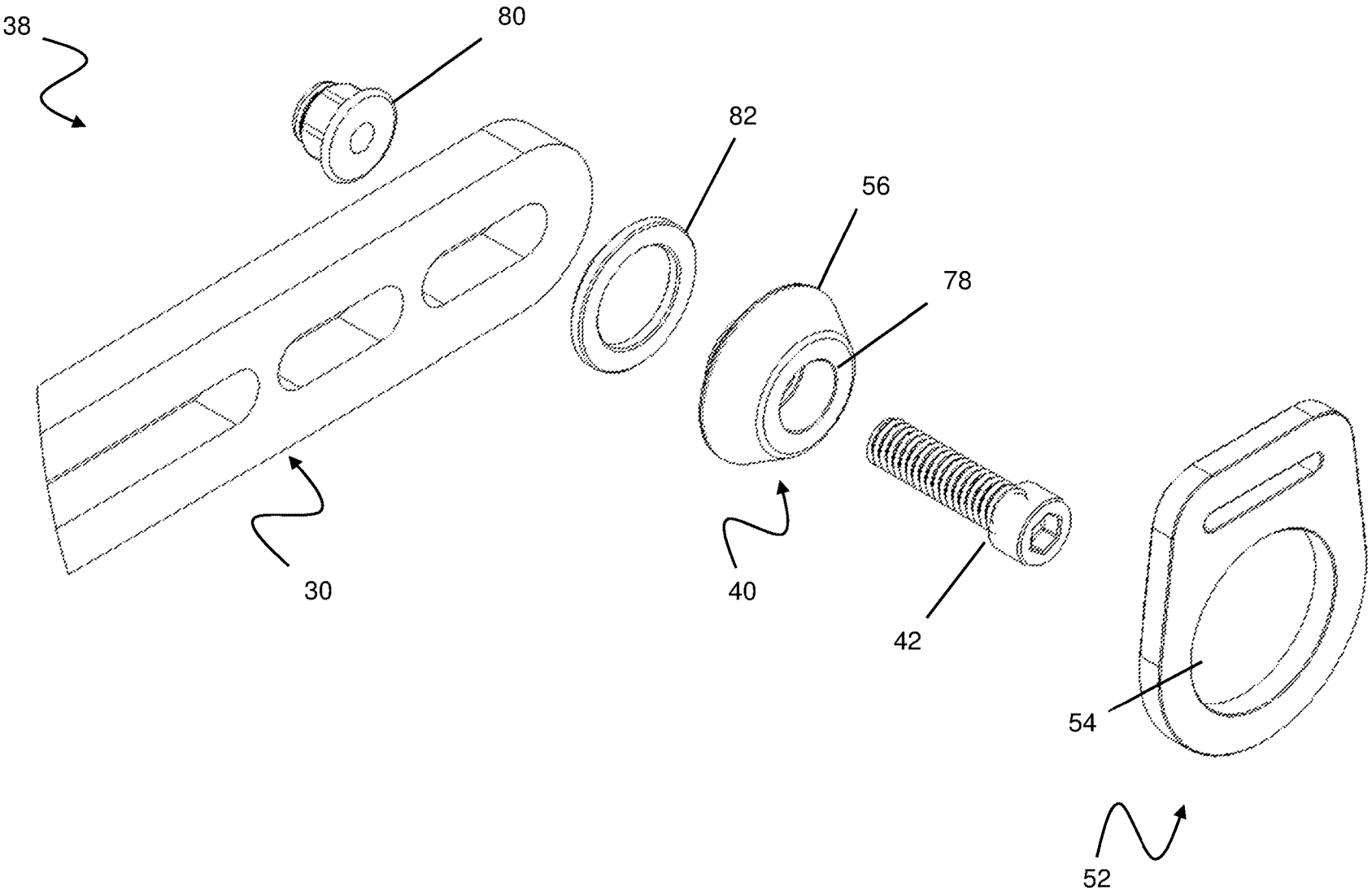
FIG. 5 shows an exploded three-dimensional view of a second example of a lifting system.

A second embodiment of the lifting system 38 is shown in FIG. 5. The second embodiment is similar to the first embodiment, and like features will not be repeated for the sake of brevity.

A fastener 42 extends through the head portion 56 via an aperture 78 therein. The fastener is connected to a retainer (e.g. a nut 80) on the opposing side of the bracket 30. The pin 40 is therefore releasable from the side bracket 30 adjacent the head portion 56.

The locating feature 58 is absent in the second embodiment. The head portion 56 and the clip aperture 54 are therefore circular. The head portion 56 retains the tapered surface, thus providing a frustoconical shape.

Rattling of the clip 52 is prevented using one or more magnet. A magnet may be provided on one or more of the clip 52, pin 40 or bracket 20, which is attracted to a magnetic material or magnet on the clip 52, pin 40 or bracket 20 accordingly. Additionally, this may further prevent unintentional disconnection of the pin 40 and clip 52, i.e. by attracting the clip onto the magnet/shaft behind the head portion 56 such that the clip is offset from the alignment required to remove the clip from the pin.

In the present embodiment, the magnet is embedded in/on the pin 40, thus retaining clip 52 against the pin 40. The magnet comprises an annular/ring shaped magnet 82. The magnet is attached to a side of the head portion 56 proximal the bracket 30 (i.e. interposed the pin 40 and bracket 30).

In some embodiments, the magnet 82 is used in addition to the resilient member 66 of the previous embodiment.

The pin 40 and/or 52 comprise a steel and/or magnetic material. The clip 52 may comprise a mild (carbon) steel. The pin 40 may comprise a stainless steel.

The magnet comprises a neodymium magnet. However, it can be appreciated that any suitable magnetic material may be used.

The magnet 82 may act as a spacer between the bracket and head portion 56. Additionally/alternatively, the rear side of the head portion 56 may comprise a shaft or other spacer formation as described above in relation FIG. 4.

Figure 6:
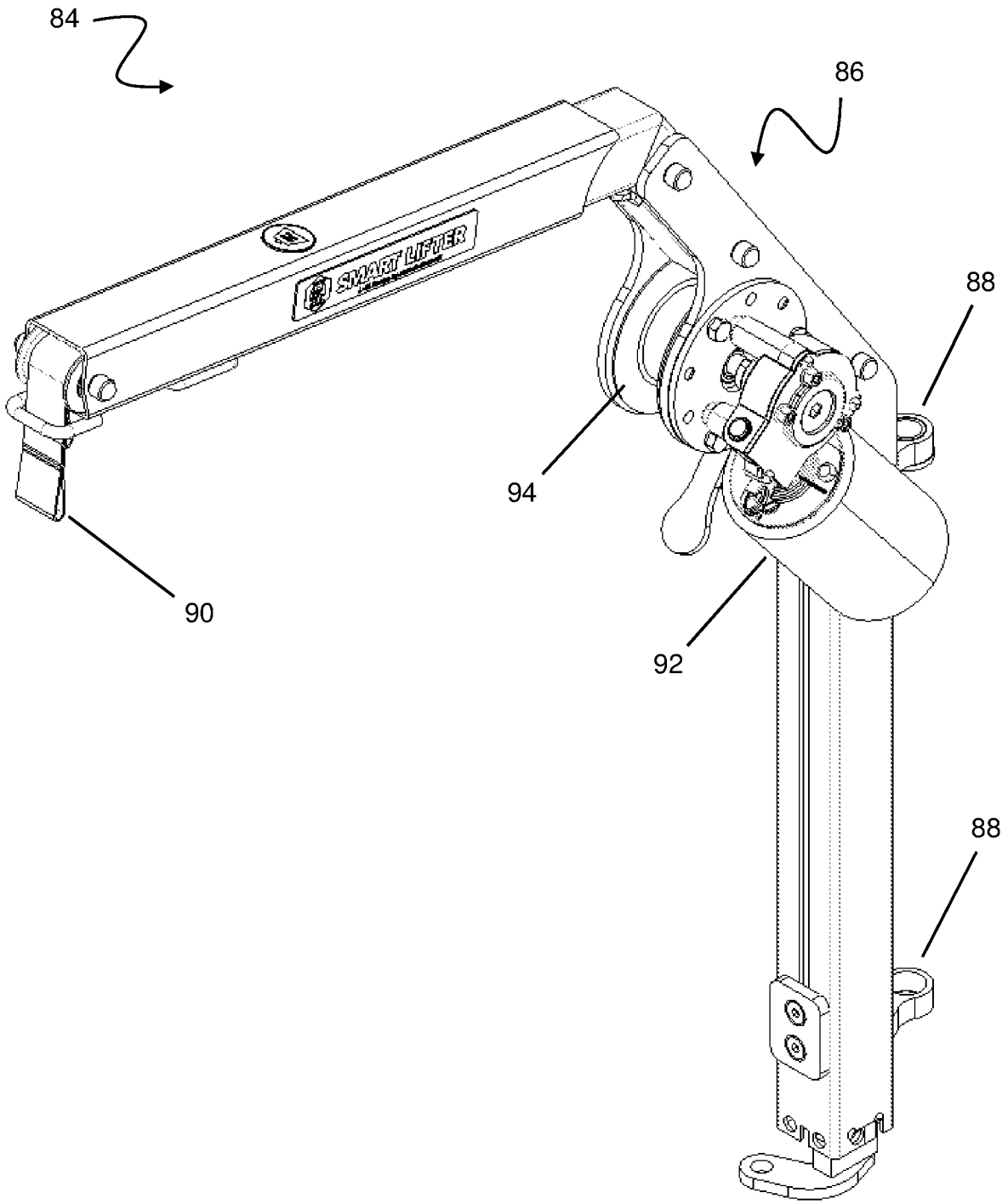
FIG. 6 shows a three-dimensional view of a hoist for use with the lifting system.
Figure 7:
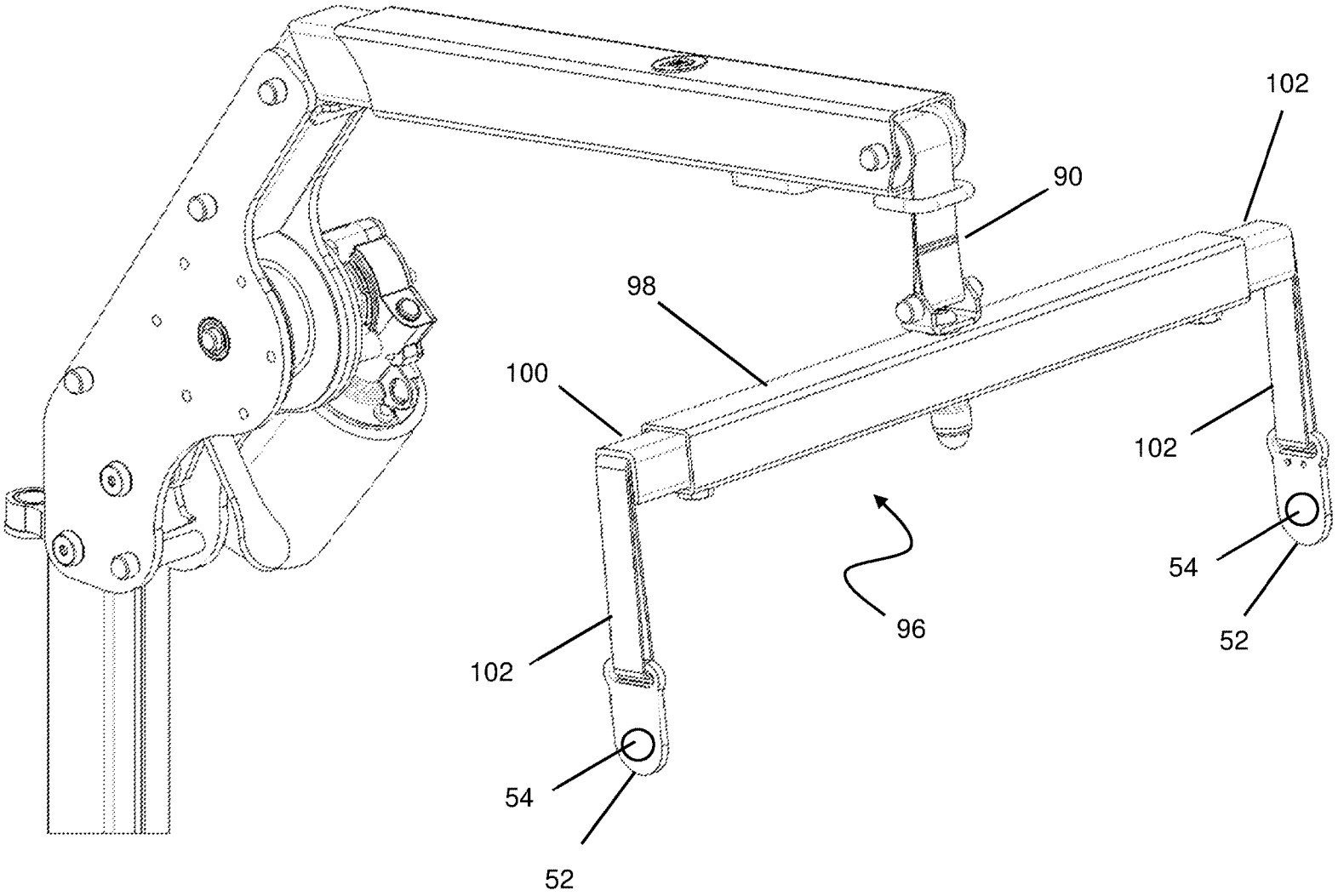
FIG. 7 shows a three-dimensional view of a hoist and spreader bar with clips depending therefrom for use with the lifting system.

The hoist mechanism 84 is shown in FIGS. 6 and 7. The hoist mechanism is described in the applicant's co-pending application GB2003138.1, which is incorporated by reference herein.

The hoist mechanism 84 is configured to be fixed to the vehicle (e.g. a car or van) adjacent a door or other opening, for example, a boot/trunk door, to allow the user to lift the load in and out of the vehicle.

The hoist mechanism 84 comprises a boom generally indicated at 86. The boom 86 is configured to be rotationally attached to the vehicle. The boom 86 comprises a plurality of connectors 88 to allow a connection to a post or other fixture within in the car. The connectors 88 comprise apertures/loops to permit rotation relative to the post. The hoist 84 may therefore be stored inside the vehicle when not in use and then swung out of the vehicle when required. A rotatable connection may also be provided at a base of the boom 86. The boom is thus swivelable as a whole about an upright/vertical axis.

The boom 4 comprises a metallic beam, for example, a steel box-section.

Webbing, referred to herein as a belt 90, depends from the boom structure 86 over the distal/free end thereof and is configured to be attached to the article to be lifted, e.g. the mobility scooter.

An actuator 92, in the form of an electric motor, is mounted to the boom 86 structure. In this example the actuator 92 is mounted to a central portion of the boom 86 along with a spool 94 for the belt 90.

The belt 90 is operatively connected to an actuator 92 to retract/extend the belt 90. The belt 90 extends through/along a hollow interior the boom 86, thereby preventing the user interfering with the belt 90.

The belt 90 is connected to the spool 94 and the belt 90 is configured to be wound to/from the spool 94 by the actuator 92. The hoist 84 therefore provides a winch like arrangement for selective payout/retraction of the belt 90.

As shown in FIG. 7, the belt 90 comprises a connection member 96 to orient the belt 90 for connection to the scooter. The connection member 96 comprises a cross-bar or spreader-bar 98, arranged to be substantially horizontal in use. End portions 100 are telescopically connected to the cross-bar 98, allowing variation of the width of the connection member 96. A further belt 102 extends from the end portions 100. The clips 52 are attached to the end of respective further belts 102.

In use, the hoist mechanism 84 is brought into alignment with the mobility scooter, such that the spreader bar 98 is over the seat post 18 and the clips 52 are proximal the brackets 30. The clips 52 can then be passed over the respective pins 40, thereby securing the hoist mechanism to the scooter via the lifting system. The scooter may then be raised or lowered using the hoist mechanism as required.

The present invention avoids the use of spring clips or carabiners or the like, therefore allowing simple and convenient disconnection of the mobility scooter from the hoist mechanism. Due to the loose connection between the pin and the clip, disconnection can be performed using a single hand and can be perform by those with mobility/dexterity issues. However, the close fit prevents rattling of the clip, which can be noisy and/or cause to the clip to disconnect.

The resilient member and/or magnet prevent rattling of the clip, thus preventing unintentional disconnection of the hoist mechanism and the scooter and/or irritation to the user.

The lifting system provides a compact configuration thus allow use of the hoist mechanism in more compact environments. Additionally, this provides more space for the user's hand if disconnection of the hoist and the scooter is required.

What is claimed is:

1. A lifting system for a mobility device comprising:

a bracket fixed to the mobility device, a hoist connector configured to removably connect to the bracket to provide lifting of the mobility device in use;

where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation such that the clip is loosely held on the pin, and where the clip is configured to prevent unintentional disengagement from the pin in use, and wherein a magnet is provided on a side of the head formation proximal the bracket and is arranged to retain the clip on the pin and to bias the clip away from a condition in which the aperture is aligned with the head formation when in engagement with the pin.

2. A lifting system according to claim 1, where a shape of an outer surface of the head formation is configured to conform to the shape of an inner surface of the clip opening.

3. A lifting system according to claim 1, where the neck formation comprises a spacer arranged to abut the bracket to hold the head formation at a predetermined spacing from the bracket in use.

4. A lifting system according to claim 1, where the neck formation comprises a shaft portion configured to extend through the bracket.

5. A lifting system according to claim 4, where the neck formation comprises the shaft portion and a spacer, a width or a profile of the spacer being different from a width and/or a profile of the shaft portion.

6. A lifting system according to claim 1, where the magnet is interposed between the head formation and the bracket and/or surrounds the neck formation of the pin.

7. A lifting system according to claim 1, where the magnet comprises one or more side wall configured to engage the head formation and/or the bracket.

8. A lifting system according to claim 1, where the magnet is formed of a resilient material.

9. A lifting system according to claim 1, where the head formation comprises a locating feature configured to engage a corresponding locating feature on the clip to ensure correct orientation of the clip relative to the head formation when the clip is passed over the pin.

10. A lifting system according to claim 1, where the head formation and/or aperture are substantially circular.

11. A lifting system according to claim 1, where one or both of the clip and the pin comprises an angled/chamfered surface configured to guide the clip and pin into alignment when passing thereover.

12. A lifting system according to claim 11, where the angled/chamfered surface is provided on one side of the head formation or clip only and/or an opposing side of the head formation or clip comprises a flat face.

13. A lifting system according to claim 1, where the bracket comprises an elongate aperture therein and the pin is connected to the bracket through the aperture at a desired location along a length of the aperture, and a portion of the pin comprises at least one flat surface configured to engage the elongate aperture to prevent rotation of the pin therein.

14. A lifting system according to claim 1, where the bracket is connected to the mobility device via an upstanding post of the mobility device, the bracket being rigidly mounted with the upstanding post.

15. A lifting system for a mobility device comprising:

a bracket fixed to the mobility device, a hoist connector configured to removably connect to the bracket to provide lifting of the mobility device in use;

where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation such that the clip is held on the pin, and where the lifting system comprises a biasing member arranged to bias the clip away from a condition in which the aperture is aligned with the head formation when in engagement with the pin, and wherein a magnet is provided on a side of the head formation proximal the bracket and is arranged to retain the clip on the pin and to bias the clip away from a condition in which the aperture is aligned with the head formation when in engagement with the pin.

16. A lifting system for a mobility device comprising:

a bracket fixed to the mobility device, a hoist connector configured to removably connect to the bracket to provide lifting of the mobility device in use;

where one of the bracket and the hoist connector comprises a pin and the other of the bracket and the hoist connector comprises a clip, the pin comprising a head formation and a neck formation, wherein the clip comprises an aperture configured to pass over the head formation in use and into engagement with the neck formation such that the clip is loosely held on the pin, and where the clip and/or pin comprises an angled/chamfered surface configured to guide the clip and pin into alignment when passing thereover, and wherein a magnet is provided on a side of the head formation proximal the bracket and is arranged to retain the clip on the pin and to bias the clip away from a condition in which the aperture is aligned with the head formation when in engagement with the pin.

* * * * *